US007025207B2

(12) United States Patent
Breu et al.

(10) Patent No.: US 7,025,207 B2
(45) Date of Patent: Apr. 11, 2006

(54) PACKAGING COMPRISING AT LEAST ONE CARRIER SECTION BEARING PACKAGING ITEM AND METHOD FOR THE PRODUCTION AND FILLING OF SAID PACKAGING

(75) Inventors: Gerhard Breu, Güttingen (CH); Erich Specker, Altstätten (CH)

(73) Assignee: Dividella AG, Grabs (CH)

( * ) Notice: Subject to any disclaimer, the term of this patent is extended or adjusted under 35 U.S.C. 154(b) by 141 days.

(21) Appl. No.: 10/479,995

(22) PCT Filed: Nov. 12, 2001

(86) PCT No.: PCT/CH01/00664

§ 371 (c)(1),
(2), (4) Date: Dec. 8, 2003

(87) PCT Pub. No.: WO02/100736

PCT Pub. Date: Dec. 19, 2002

(65) Prior Publication Data

US 2005/0035023 A1 Feb. 17, 2005

(30) Foreign Application Priority Data

Jun. 11, 2001 (EP) ..... 01114120

(51) Int. Cl.
*B65D 83/04* (2006.01)

(52) U.S. Cl. ..... 206/531; 206/461; 206/470; 206/532; 206/539

(58) Field of Classification Search ..... 206/461, 206/470, 528–534, 538, 539
See application file for complete search history.

(56) References Cited

U.S. PATENT DOCUMENTS

| | | | | |
|---|---|---|---|---|
| 2,110,572 | A * | 3/1938 | Foote | 206/570 |
| 3,567,013 | A * | 3/1971 | Tannebaum | 206/538 |
| 5,109,984 | A | 5/1992 | Romick | |
| D358,546 | S * | 5/1995 | Walchek et al. | D3/203.3 |
| 5,954,202 | A | 9/1999 | Mellon | |
| 6,219,997 | B1 * | 4/2001 | Friberg et al. | 53/453 |

FOREIGN PATENT DOCUMENTS

| | | |
|---|---|---|
| GB | 467 606 | 6/1937 |
| GB | 2 266 880 | 11/1993 |

* cited by examiner

*Primary Examiner*—Mickey Yu
*Assistant Examiner*—Jerrold Johnson
(74) *Attorney, Agent, or Firm*—Nath & Associates PLLC; Gregory B. Kang; Teresa M. Arroyo

(57) ABSTRACT

A carrier section (2) is captively integrated into a box which is stabilized in a folding and glueing operation, said box comprising four side walls (5, 5', 6, 6') connected approximately at right angles to a base section (4). One of the side walls is embodied in the form of an articulated strip (7), at least as far as part of the length thereof is concerned. Said strip can be pivoted on the plane of the base section (4) and is coupled to the carrier section (2).

18 Claims, 7 Drawing Sheets

Figure 1:
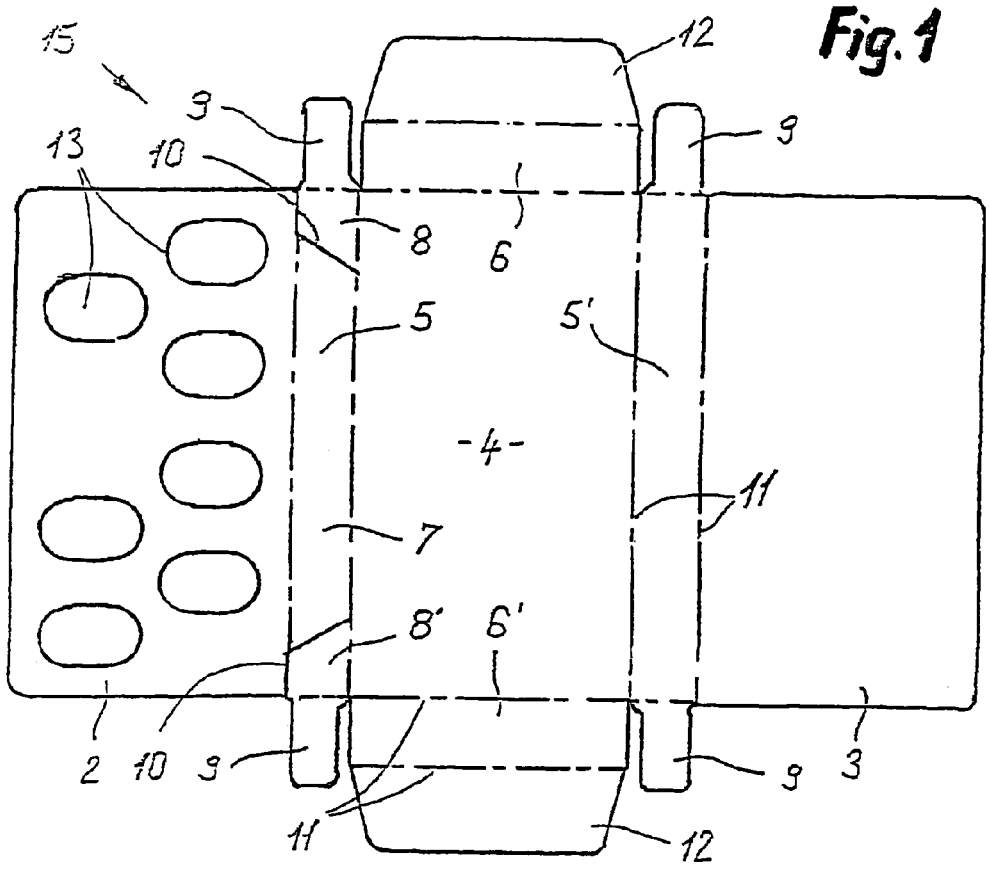

3
17
11
5'
9
9
12
12
6
6'
-4-
8
7
5
8'
11
9
10
10
9
2a
13
18
11
13
2b 28
3
31
11
5'
14'
35
34
32
-4-
32'
7
30
5
33
14
36
2
37
2'

PACKAGING COMPRISING AT LEAST ONE CARRIER SECTION BEARING PACKAGING ITEM AND METHOD FOR THE PRODUCTION AND FILLING OF SAID PACKAGING

The invention relates to packaging comprising at least one carrier section bearing packaging contents according to the preamble of independent claims 1 and 6. In the case of such packaging, in contrast to packaging contents being packaged loosely in boxes, at least one carrier section is firmly connected to a protective casing which encloses it, with the result that the packaging contents, e.g. a blister sheet, cannot be damaged accidentally.

Packaging of a comparable generic type has been disclosed, for example, by GB-A-2 266 880. The protective casing here forms a type of wallet, in the case of which the blister section is integral with a narrow side. One disadvantage of this packaging, however, is that the protective casing is not resistant to pressure because it does not have any stable side walls. Moreover, it is possible for dust and dirt to penetrate into the corner regions.

An alternative solution of such packaging has been disclosed by U.S. Pat. No. 5,954,202. According to a particular embodiment, the side walls which adjoin the base section are connected to one another in the erected position. The operations of erecting and stabilizing the box prior to loading of the carrier section, however, are only possible with considerable outlay because, for the loading operation, the carrier section should lie flat.

It is thus an object of the invention to provide packaging of the type mentioned in the introduction which combines the advantages of a stable box for the packaging contents with a single-piece design of the blank, without the production of the packaging being rendered excessively more difficult in the process. This object is achieved according to the invention by packaging which alternatively has the features in claim 1 or in claim 6.

According to a first embodiment of the invention, one side wall forms an articulation strip which is connected to the abutting box side walls such that the carrier section, in the use position, can be pivoted into the plane of the base section, and that the abutting box side walls are stabilized at least in the rest position, the carrier section being articulated on the articulation strip. The connection advantageously takes place via in each case one articulation fold, which connects the articulation strip to the abutting box side walls in each possible relative position.

The abutting box side walls are advantageously designed as approximately prismatic hollow side walls each with an outer wall and an inner wall, which can be erected in the manner of a parallelogram from the plane of the base section. It is possible here for each articulation fold to adjoin an outer wall of a hollow side wall. Packs comprising a single blank with hollow side walls have already been disclosed, for example, by EP-A-172 133. Such packaging has the advantage that it can be supplied in the flat state as prefabricated blanks, and that good stability in relation to pressure is achieved once the hollow side walls have been erected.

It is particularly advantageous for the folded-in articulation fold in the rest position, in the case of each hollow side wall, to butt against the inner wall on the end side, as a result of which it is retained in the plane of the erected articulation strip. The situation where the hollow side wall is pivoted outward is thus reliably avoided, because the articulation fold cannot open.

The lid section may be articulated on the base section in precisely the same way as the carrier section. In particular, it may likewise be arranged on a wall section which is connected to the abutting box side walls via in each case one articulation fold.

According to an alternative embodiment of the invention, it is possible for at least one side wall to form an articulation strip which extends only over part of the side length of the box, it being the case that remaining on both sides of the articulation strip is in each case one residual side wall which is firmly connected to abutting box side walls and adjoins the articulation strip in the rest position. Here too, the carrier section, which is articulated on the articulation strip, can be pivoted into the plane of the base section in the use position, although the box is stabilized in the rest position and in the use position.

In this way, the box achieves four rigidly adhesively bonded corner regions, as a result of which the stability in relation to pressure and the torsional rigidity is obviously increased. It is particularly advantageous here if the articulation strip butts against the residual side walls in the rest position, with the result that sufficient sealing is achieved. The sealing of the packaging may be increased further if the lid section is articulated on the box side wall parallel to the articulation strip and if in each case one dust flap is arranged on the box side walls running transversely to the articulation strip.

Depending on the size of the box, at least a second carrier section may be arranged on a first carrier section via an articulation crosspiece. The articulation crosspiece, at the same time, ensures a certain spacing between the two carrier sections in the rest position. It would also be conceivable for a plurality of carrier sections to be positioned one beside the other in a row in the manner of an accordion.

The lid section may be retained in the closed position by at least one adhesive strip. It would also be conceivable, however, to have at least one insertion tongue, as is already known per se in the case of folding boxes.

The carrier section may bear, for example, a blister sheet with the packaging contents welded therein. Such blister sheets are also used, in particular, for packaging pharmaceutical products, such as pills or capsules. The carrier section here may have openings, the blister sheet being adhesively bonded to the carrier section such that the packaging contents welded therein, for example, tablets or capsules, are located in the region of the openings. In this way, it is possible for the packaging contents to be pressed through the openings for removal purposes.

It is also possible, however, for the carrier section to bear at least one individual container which can be separated off at a predetermined breaking point. The individual container may be a bottle-like or ampoule-like structure made of plastic material. A foil bag, tubular bag or the like, however, is also conceivable. Such containers are also used, for example, for giving away samples of perfume, ointments, etc.

The individual container may have a removal opening with a closure element, and the closure element may be connected directly or indirectly to the carrier section, and the predetermined breaking point may be arranged between the removal opening and closure element, such that the individual container is opened once it has been separated off. An entire continuous row of individual containers may particularly advantageously be arranged on the carrier section.

The invention also relates to a method of producing and filling packaging described above, which has the features in claim 15. Considerable rationalization is achieved here in that the operations of producing a stable box and of fitting the packaging contents in captive fashion can take place one behind the other on the same packaging line. It is also the case that, once the box has been erected and adhesively bonded, the carrier section remains on the same horizontal plane as the base section, with the result that the packaging contents can be attached by adhesive bonding.

The blanks used for producing the box are preferably printed beforehand, a further advantage of the packaging being that it is also possible for the end sides to contain information which is clearly visible during storage. Before the carrier section is swung in, a separate information leaflet may be positioned in the box. As an alternative, or in addition, it would also be possible for an information leaflet to be fastened on the inside of the lid section, to be precise preferably before the box is erected.

Figure 2:
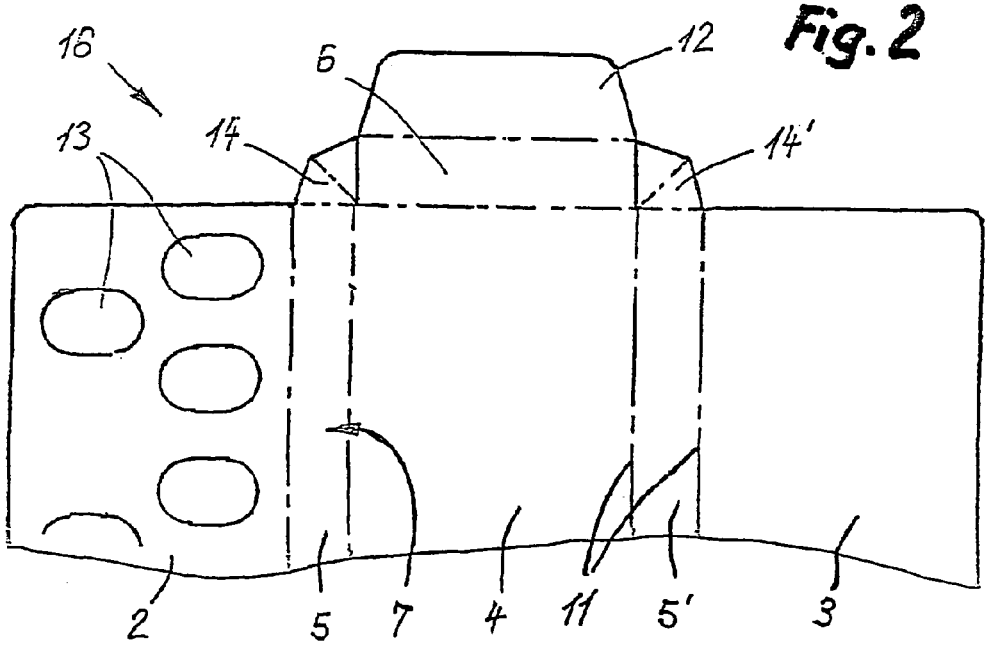
Figure 3:
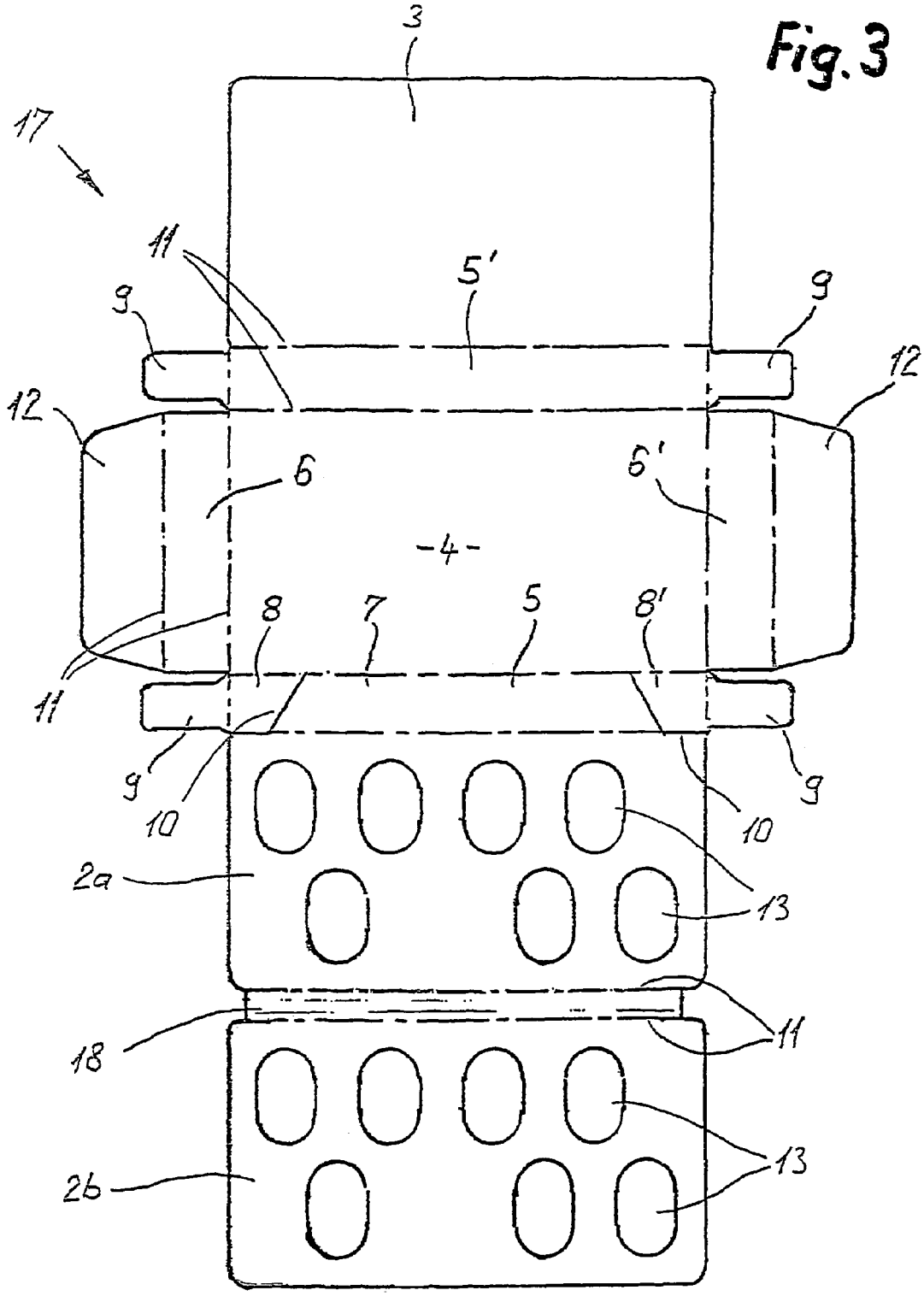
Figure 4:
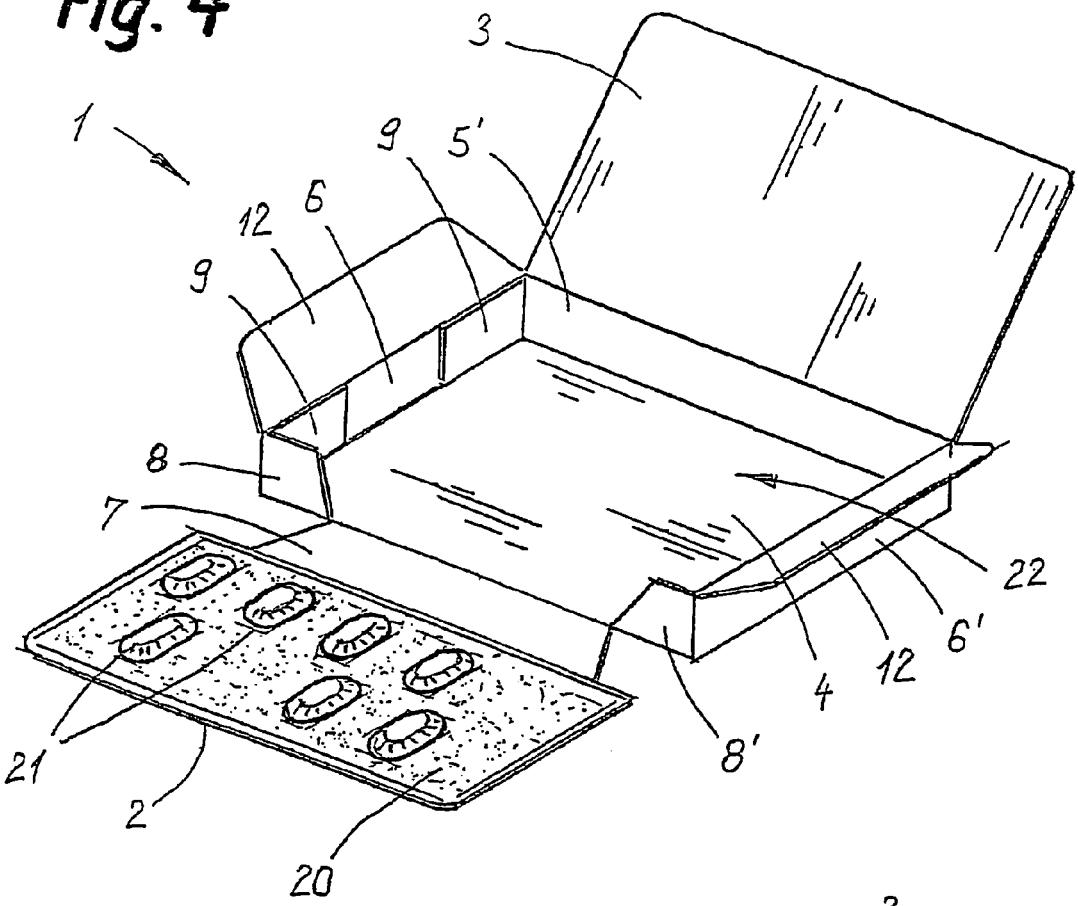
Figure 5:
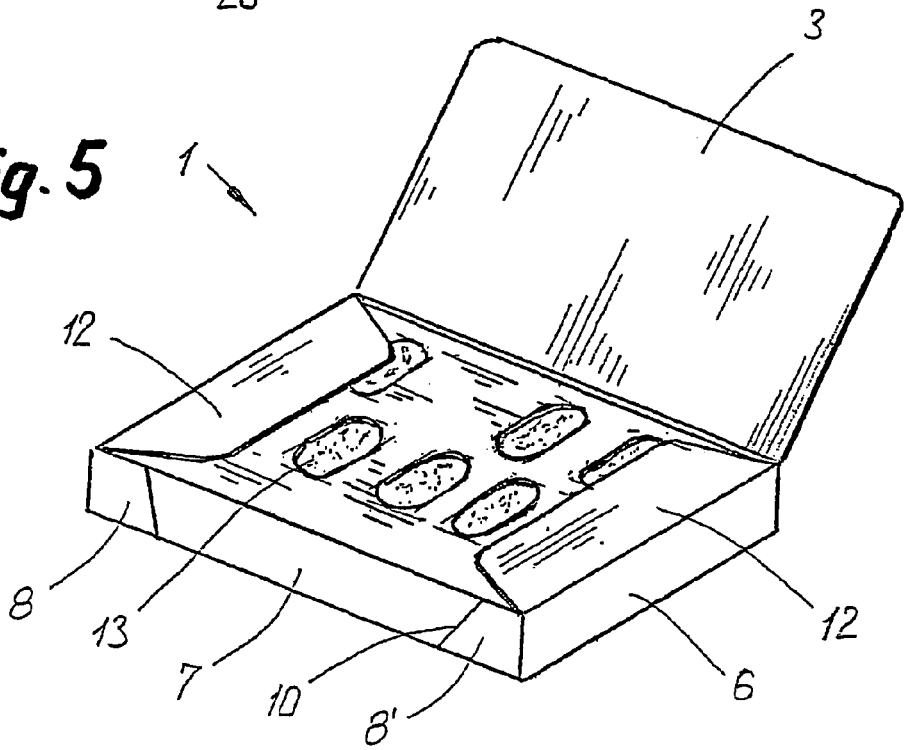
Figure 6:
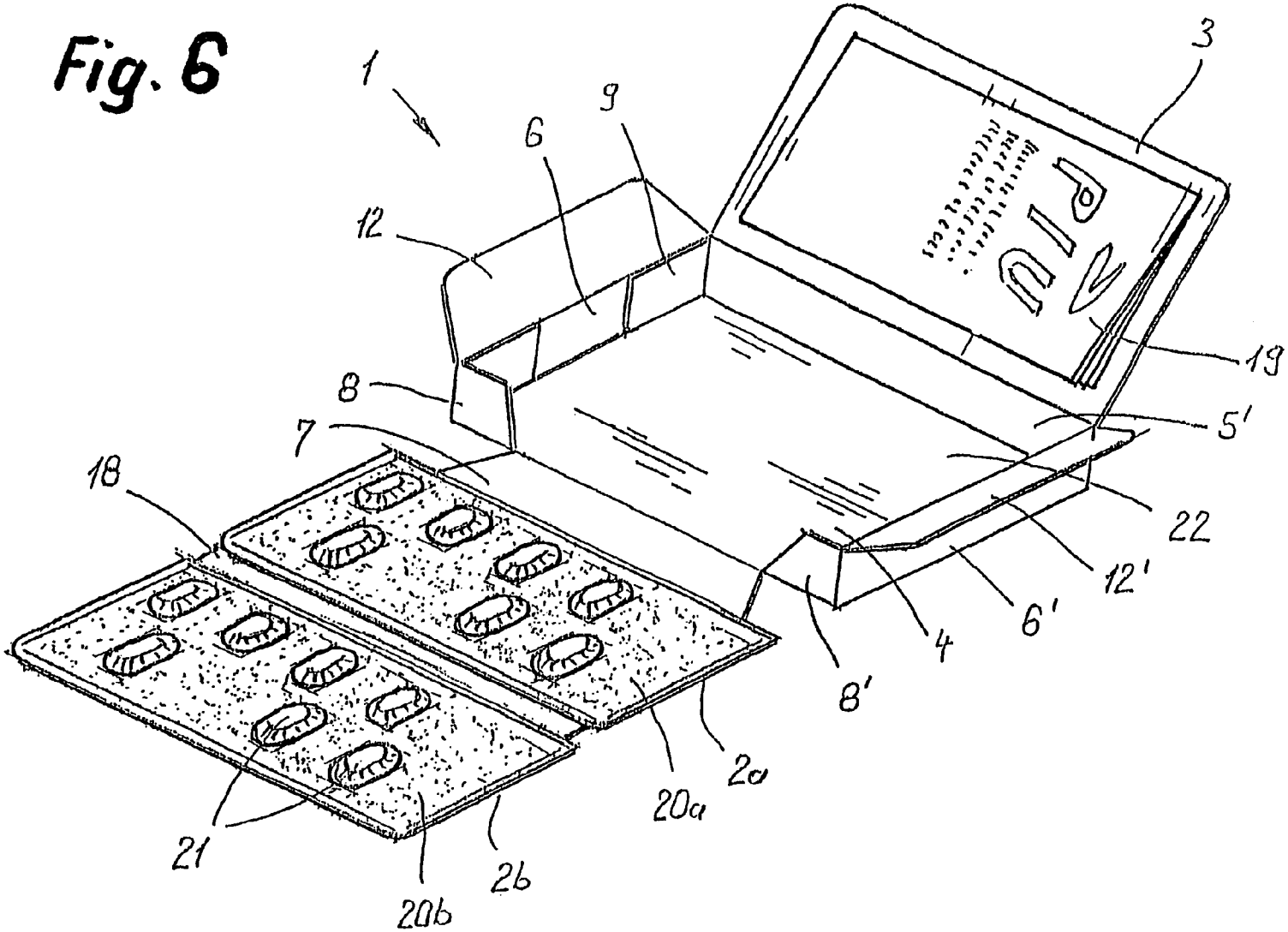
Figure 7:
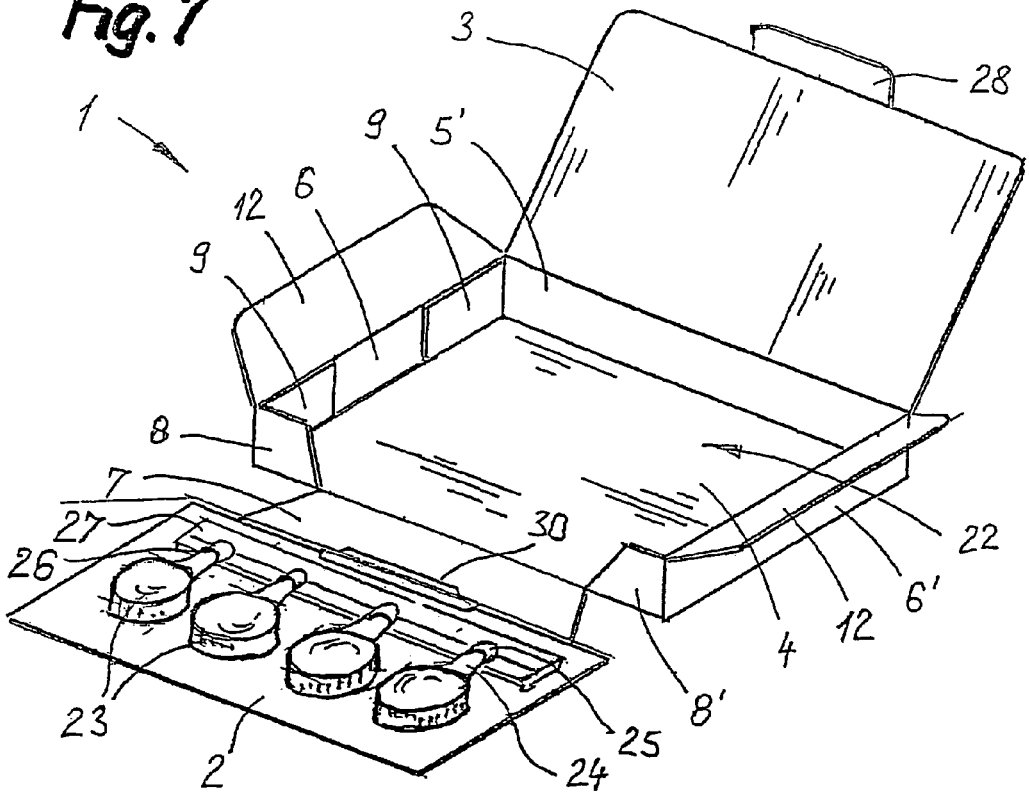
Figure 8:
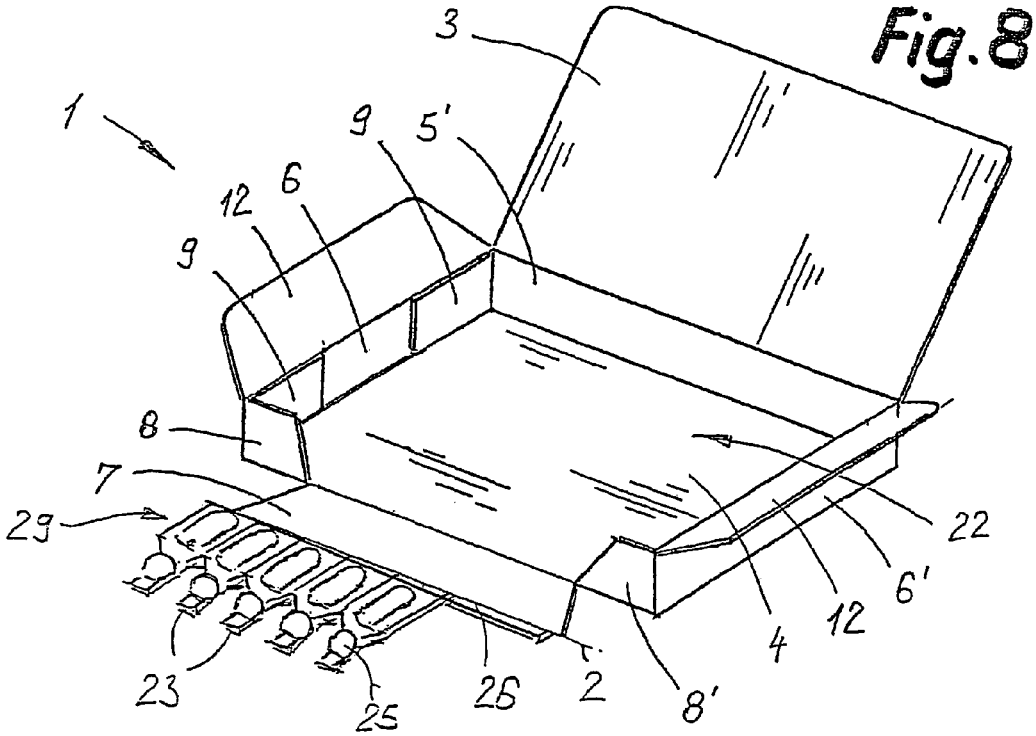
Figure 9:
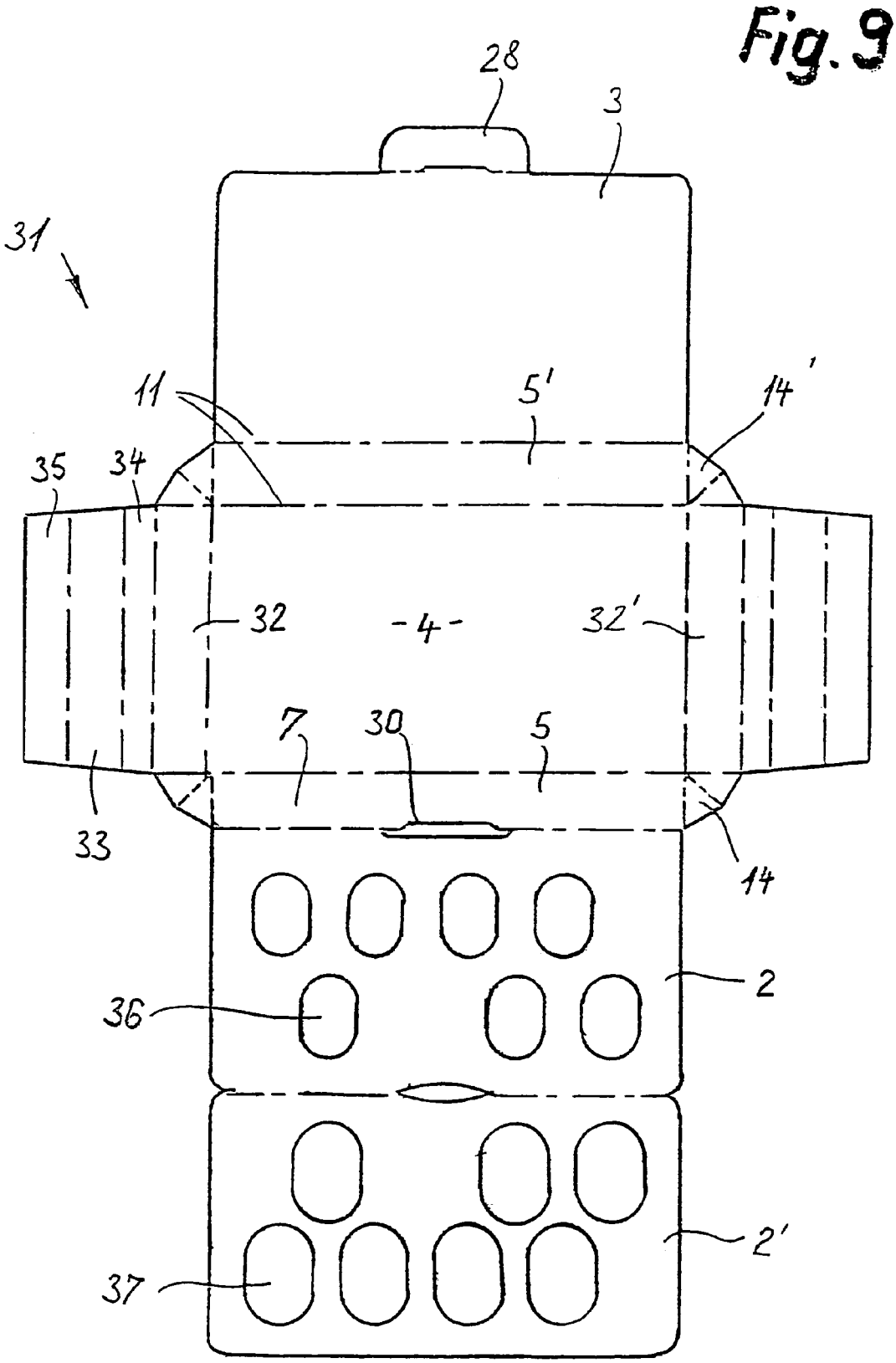
Figure 10:
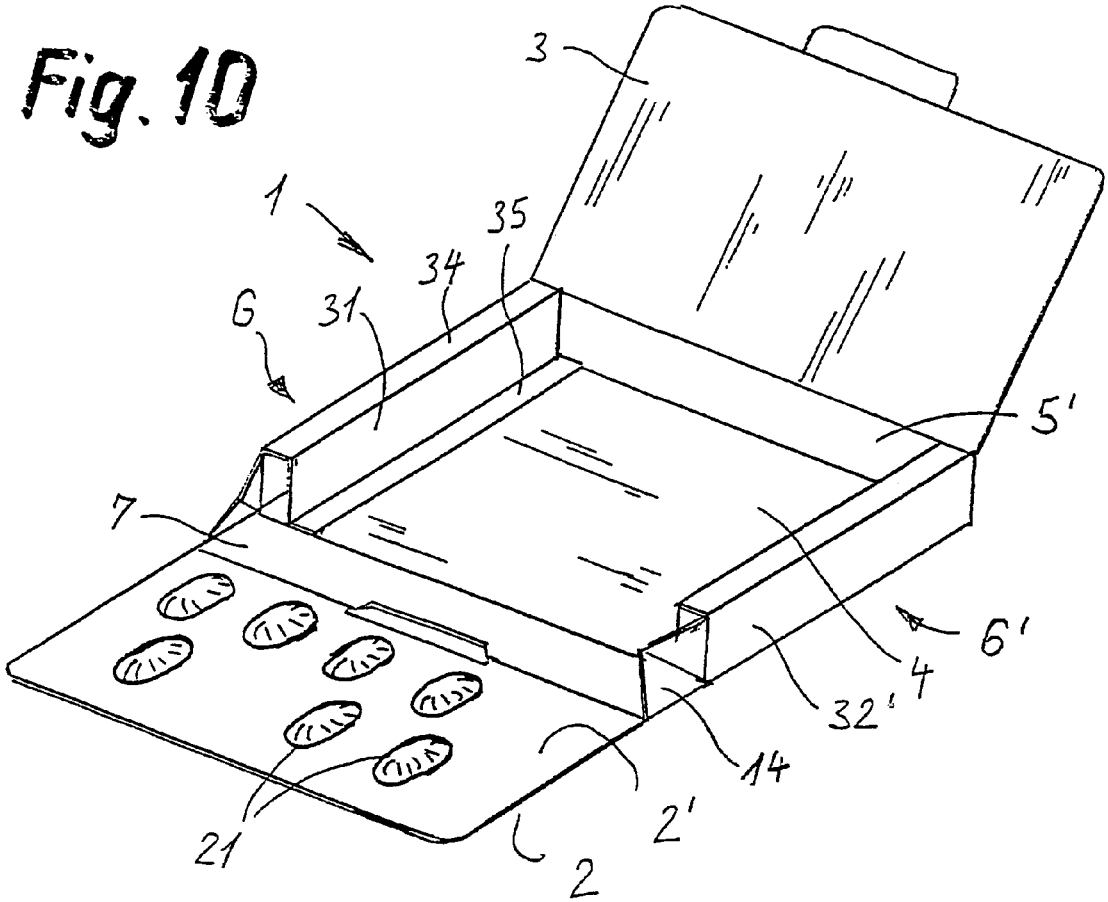
Figure 11:
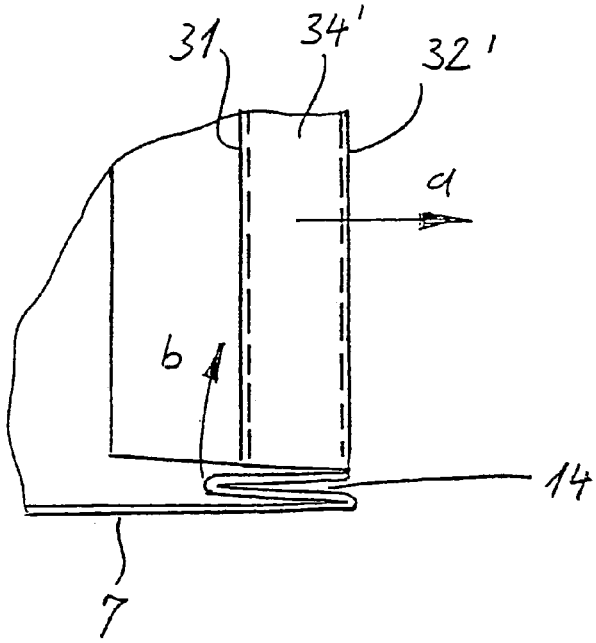

Further advantages and individual features can be gathered from the following description of exemplary embodiments and from the drawings, in which:

FIG. 1 shows a first blank for a box with four rigidly adhesively bonded corner regions, FIG. 2 shows an only partially illustrated second blank for a box with a side wall which can be swung out to the full extent, FIG. 3 shows a third blank with two carrier sections, FIG. 4 shows a perspective illustration of packaging produced from the first blank according to FIG. 1, FIG. 5 shows the packaging according to FIG. 4 with the carrier section swung in, FIG. 6 shows a perspective illustration of packaging produced from the second blank according to FIG. 3, FIG. 7 shows a perspective illustration of a further exemplary embodiment of packaging with individual containers, FIG. 8 shows a perspective illustration of a further exemplary embodiment of packaging with alternative individual containers, FIG. 9 shows a fourth blank for a box with prismatic hollow side walls, FIG. 10 shows a perspective illustration of packaging produced from the blank according to FIG. 9, and FIG. 11 shows an enlarged plan view of the end side of a hollow side wall with abutting articulation fold.

FIG. 1 shows a single continuous blank 15, for example made of cardboard or of a laminate, with a rectangular base section 4, the longitudinal side walls 5, 5' adjoining the longitudinal sides of the latter and the transverse side walls 6, 6' adjoining the transverse sides thereof. In each case one dust flap 12 adjoins the transverse side walls 6, 6'. A carrier section 2 is arranged on the longitudinal side wall 5 and a lid section 3 is arranged on the longitudinal side wall 5'. Adhesive flaps 9 are also arranged at the ends of the longitudinal side walls 5, 5'.

The various material sections are separated from one another by folding lines 11. An exception here is constituted by the angled incisions 10, which subdivide the longitudinal side wall 5 into an articulation strip 7 and into two residual side walls 8, 8'. The incisions 10 here extend, as can be seen, over the entire width (corresponding to the subsequent height) of the longitudinal side wall 5.

Oval openings 13 are punched out of the carrier section 2, their configuration and position being adapted to a blister sheet which is subsequently attached by adhesive bonding.

The alternative blank 16 according to FIG. 2 differs from the abovedescribed blank merely by the fact that the longitudinal side walls 5, 5' and the transverse side walls 6, 6' are connected to one another by an articulation fold. In this case, the entire longitudinal side wall 5 forms an articulation strip 7 which can be swung out around the articulation fold 14. In contrast, for the purpose of stabilizing the box, the articulation fold 14' may be adhesively bonded, with the result that a stable box is nevertheless produced.

Finally, the blank 17 according to FIG. 3, in addition to a first carrier section 2*a*, also has a second carrier section 2*b*. The two carrier sections are connected to one another in an articulated manner via an articulation crosspiece 18. The rest of the material sections are configured in the same way as for the exemplary embodiment according to FIG. 1.

FIG. 4 shows the packaging 1 once the side walls have been erected and adhesively bonded. For this purpose, the adhesive flaps 9 are adhesively bonded to the transverse side walls 6 and 6'. As can be seen, the residual side walls 8, 8' remain in the erected position here, while the incisions 10 (FIG. 1) ensure that the articulation strip 7, and thus also the carrier section 2, can be swung out into the plane of the base section 4.

In this position, a blister sheet 20, in which individual packaging chambers 21 are welded, is attached by adhesive bonding. Once the blister sheet has been attached by adhesive bonding, on the same packaging line, the carrier section 2 is swung into the interior 22 of the box.

This position is illustrated in FIG. 5. The rear side of the blister sheet 20 can be seen through the openings 13, a packaging chamber being located behind each opening. Once the dust flaps 12 have been swung in, the lid section 3 is also closed and preferably fixed by an adhesive strip or by an insertion flap.

FIG. 6 shows packaging 1 produced from the blank 17 according to FIG. 3. The two separate carrier sections 2*a* and 2*b* have had likewise separate blister sheets 20*a* and 20*b* attached to them by adhesive bonding. For the purpose of closing the packaging, as can be seen, first of all the carrier section 2*b* is moved onto the carrier section 2*a* around the articulation crosspiece 18, and the entire unit is then swung into the box interior 22. An information leaflet 19 is fastened in captive fashion on the inside of the lid section 3.

In the case of the exemplary embodiments according to FIGS. 7 and 8, the box body is constructed in the same manner as, or in a similar manner to, the exemplary embodiment according to FIG. 4. The carrier sections 2, however, are configured somewhat differently and, instead of a blister sheet, the carrier sections bear a plurality of individual containers. According to FIG. 7, the individual containers 23 are in the form of essentially round phials with a pouring nozzle and/or with a removal opening 24. The removal openings are closed by a closure element 25, and the closure elements are integrated as a whole in a fastening crosspiece. A predetermined breaking point 26 runs between the removal opening 24 and closure element 25, it also being possible for the individual containers 23 to be connected to one another by predetermined breaking points.

The fastening crosspiece 27 is adhesively bonded to the carrier section 2. This itself has an outline which is somewhat smaller than the outline of the base section 4. The individual containers 23 themselves are not connected to the carrier section 2. When an individual container is broken off, the closure element 25, as can be seen, remains on the fastening crosspiece 27, with the result that the container is opened at the same time as it is broken off.

In the case of the exemplary embodiment according to FIG. 7, an insertion tongue 28 is also arranged on the lid section 3, it being possible for this tongue to be inserted into a slit 30 once the carrier section has been swung into the box interior.

In the case of the exemplary embodiment according to FIG. 8, the carrier section 2 merely comprises a relatively narrow strip. The individual containers 23 are ampoule-like structures made of plastic material which are arranged in a continuous row 29. The individual ampoules may be released from the carrier section 2 at the predetermined breaking point 26, it also then being necessary for the closure element 25 to be twisted off separately. Such containers are suitable, for example, for the individual portioning of adhesive or the like.

The blank 31 according to FIG. 9, like the rest of the blanks, likewise has a base section 4 and a lid section 3, the latter being connected to the former in an articulated manner via a longitudinal side wall 5'. It is also the case that the carrier section 2 or 2' is connected to the base section 4 via the longitudinal side wall 5, which simultaneously forms the articulation strip 7.

In contrast to the exemplary embodiment according to FIG. 3, the two sections 2 and 2' do not serve for accommodating separate blister sheets. Rather, the single blister sheet is adhesively bonded in a sandwich-like manner between the two carrier sections 2 and 2'. For this reason, it is also the case that the two sections are only separated from one another by a folding line. The cut-out openings are of different sizes. The removal openings 36 are somewhat smaller than the product openings 37, but are arranged in a mirror-inverted manner in relation to the same. The products welded in the blister sheet project out of the product openings 37, and are pressed out through the sheet at the removal openings 36.

For the formation of the side walls abutting the articulation strip 7, in each case one outer wall 32, 32' an inner wall 33, 33', a connecting crosspiece 34, 34' and an adhesive flap 35, 35' are arranged on the blank 31. The outer walls 32, 32' and the longitudinal side walls 5, 5' are connected to one another via in each case one articulation fold 14, 14'. Also arranged on the lid section 3 is an insertion tongue 28, which can be inserted into the slit 30 in the rest position.

For the purpose of preparing the blank 31, in the first instance the adhesive flaps 35, 35' are adhesively bonded to the base section 4, to be precise such that the sections 34, 34', 33, 33' and 35, 35' are swung over around the folding lines between 32 and 34 and between 32' and 34'. This principle is known to the person skilled in the art from EP-A-172 133, which was mentioned in the introduction. In this prefabricated state, the blank 31 may be fed to a loading station for loading with a blister sheet.

FIG. 10 shows the packaging 1 which has been produced from the blank 31 and has the carrier section 2, 2' swung out into the plane of the base section 4. The hollow side walls 6, 6', or the outer walls 32, 32' thereof, remain connected to the carrier section here via in each case one articulation fold 14. It is indeed possible, but not absolutely necessary, for the articulation folds 14, 14' (which cannot be seen here) to be adhesively bonded to the longitudinal side wall 5' for stabilizing purposes. Their articulation function can be maintained, with the result that it is also possible for the lid section 3 to be pivoted back into the plane of the base section 4. The hollow side walls 6, 6' then tend to tilt some way outward on account of their restoring behavior. When the carrier section is folded in and/or when the lid section is closed, the hollow side walls 6, 6' are nevertheless erected again into their vertical position.

It is particularly important in this context for it to be possible for the closed articulation folds to be supported against the inner walls 31, 31' on the end side, as is illustrated in FIG. 11. This is because a closed articulation fold 14 is thus fixed between the end side of an inner wall 31 and the articulation strip 7 (or the longitudinal side wall 5'). It is because, in order for a hollow side wall to be pivoted outward in arrow direction a, the articulation fold would have to pivot out in arrow direction b, which is prevented by the fixing action. As can be seen, the packaging thus remains fully stable in the corner regions in the rest position, even without adhesive bonding.

It would obviously also be possible for different packaging contents to be fastened on the carrier section, although it is not absolutely necessary for the packaging contents, for their part, to be enclosed in a sheet or in a container. In certain cases, it would be conceivable for the packaging contents to be adhesively bonded directly to the carrier section, for example in the case of solid stick-like lighting aids, single-use nail files, puncture repair kits for bicycle wheels and the like.

The invention claimed is:

1. Packaging (1) comprising:

at least one carrier section (2) bearing packaging contents; and a protective casing which is connected to said carrier section (2) and has at least one base section (4) and a lid section (3), the carrier section (2) capable of being articulated on the protective casing such that the carrier section (2) can be swung out of a rest position between the base section (4) and lid section (3) into a use position, the base section (4) and the lid section (3) being constituent parts of a prepared box blank which has four side walls (5, 5', 6, 6') adjoining the base section (4) approximately at right angles, characterized in that one side wall forms an articulation strip (7) which is connected to the abutting box side walls such that the carrier section (2), in the use position, can be pivoted into the plane of the base section (4), and that the abutting box side walls are stabilized at least in the rest position, the carrier section (2) being articulated on the articulation strip, characterized in that the articulation strip is connected to the abutting box side walls via in each case one articulation fold, and characterized in that the abutting box side walls are designed as approximately prismatic hollow side walls each with an outer wall and an inner wall, which can be erected in the manner of a parallelogram from the plane of the base section, and in that each articulation fold adjoins an outer wall of a hollow side wall.

2. The packaging as claimed in claim 1, characterized in that the articulation fold in a folded-in position corresponding to the rest position, in the case of each hollow side wall, butts against the inner wall on the end side and is thus retained in the plane of the erected articulation strip.

3. The packaging as claimed in claim 1, characterized in that the lid section is articulated on the base section in the same way as the carrier section.

4. The packaging as claimed in claim 1, characterized in that at least a second carrier section (2*b*) is arranged on a first carrier section (2*a*) via an articulation crosspiece (18).

5. The packaging as claimed in claim 1, characterized in that the lid section (3) is retained in the closed position by at least one insertion tongue.

6. The packaging as claimed in claim 1, characterized in that the carrier section bears a blister sheet (20) with packaging contents welded therein.

7. The packaging as claimed in claim 6, characterized in that the carrier section has openings (13), and in that the blister sheet (20) is adhesively bonded to the carrier section such that the packaging contents welded therein are located in the region of the openings.

8. The packaging as claimed in claim 1, characterized in that the carrier section bears at least one individual container which can be separated off at a predetermined breaking point.

9. The packaging as claimed in claim 8, characterized in that the individual container has a removal opening with a closure element, and in that the closure element is connected directly or indirectly to the carrier section, and the predetermined breaking point is arranged between the removal opening and closure element, such that the individual container is opened once it has been separated off.

10. The packaging as claimed in claim 8, characterized in that a continuous row of individual containers is arranged on the carrier section.

11. A method of producing and filling packaging as claimed in claim 1, characterized in that the prepared box blanks are fed to a loading station, the carrier section (2), in the first instance, remaining in the plane of the base section (4), in that at least one packaging item (20) is then fastened on the carrier section, and in that, finally, the carrier section is swung into the box and the box is closed by the lid section (3).

12. Packaging (1) comprising:

at least one carrier section (2) bearing packaging items; and a protective casing which is connected to said carrier section and has at least one base section (4) and a lid section (3), it being possible for the carrier section to be articulated on the protective casing such that it can be swung out of a rest position between the base section and lid section into a use position, the base section (4) and the lid section (3) being constituent parts of a prepared box blank which has four side walls (5, 5', 6, 6') adjoining the base section approximately at right angles, characterized in that one side wall forms an articulation strip (7) which extends only over part of the side length of the box, and in that remaining on both sides of the articulation strip (7) is in each case one residual side wall (8, 8') which is firmly connected to abutting box side walls (6, 6') and adjoins the articulation strip in the rest position, it being possible for the carrier section, which is articulated on the articulation strip, to be pivoted into the plane of the base section (4) in the use position, and the box being stabilized in the rest position and in the use position.

13. The packaging as claimed in claim 12, characterized in that at least a second carrier section (2*b*) is arranged on a first carrier section (2*a*) via an articulation crosspiece (18).

14. The packaging as claimed in claim 12, characterized in that the lid section (3) is retained in the closed position by at least one adhesive strip.

15. The packaging as claimed in claim 12, characterized in that the lid section (3) is retained in the closed position by at least one insertion tongue.

16. The packaging as claimed in claim 12, characterized in that the carrier section bears a blister sheet (20) with packaging contents welded therein.

17. The packaging as claimed in claim 12, characterized in that the carrier section bears at least one individual container which can be separated off at a predetermined breaking point.

18. A method of producing and filling packaging as claimed in claim 12, characterized in that the prepared box blanks are fed to a loading station, the carrier section (2), in the first instance, remaining in the plane of the base section (4), in that at least one packaging item (20) is then fastened on the carrier section, and in that, finally, the carrier section is swung into the box and the box is closed by the lid section (3).

* * * * *